US005810569A

United States Patent [19]

Buckley et al.

[11] Patent Number: 5,810,569

[45] Date of Patent: Sep. 22, 1998

[54] PUMP HAVING A VARIABLE INSTANTANEOUS DELIVERY RATE

[75] Inventors: Paul Buckley, Rainham; Ian Roy Thornthwaite, Hempstead; John Roderick Jefferson, Rainham, all of United Kingdom

[73] Assignee: Lucas Industries public limited company, Solihull, England

[21] Appl. No.: 495,168

[22] Filed: Jun. 27, 1995

[30] Foreign Application Priority Data

Jun. 29, 1994 [GB] United Kingdom ..... 9413097
Oct. 4, 1994 [GB] United Kingdom ..... 9419955

[51] Int. Cl.[6] ..... F04B 19/02

[52] U.S. Cl. ..... 417/462; 417/221

[58] Field of Search ..... 417/462, 221, 417/219

[56] References Cited

U.S. PATENT DOCUMENTS

| | | | |
|---|---|---|---|
| 2,561,519 | 7/1951 | Leech . | |
| 3,147,746 | 9/1964 | Höfer | 417/462 X |
| 4,173,959 | 11/1979 | Sosnowski et al. . | |
| 4,358,256 | 11/1982 | Jefferson | 417/462 |
| 4,526,154 | 7/1985 | DiDominico | 417/221 X |
| 4,930,998 | 6/1990 | Scott | 417/462 |

FOREIGN PATENT DOCUMENTS

| | | | |
|---|---|---|---|
| 0 300 707 | 1/1989 | European Pat. Off. | 417/462 |
| 1 332 881 | 10/1973 | United Kingdom . | |
| 2 194 002 | 2/1988 | United Kingdom . | |
| WO 92/04539 | 3/1992 | WIPO | 417/462 |

*Primary Examiner*—Timothy Thorpe
*Assistant Examiner*—Cheryl J. Tyler
*Attorney, Agent, or Firm*—Jacobson, Price, Holman & Stern, PLLC

[57] ABSTRACT

A pump is disclosed having a variable cam arrangement under the influence of which a plunger is reciprocable. The variable cam arrangement comprises a plurality of cam rings which in an embodiment of the pump are relatively moveable in order to adjust the shape of the effective cam surface of the cam arrangement, and hence adjust the delivery rate of the pump.

17 Claims, 8 Drawing Sheets

PUMP HAVING A VARIABLE INSTANTANEOUS DELIVERY RATE

FIELD OF THE INVENTION

This invention relates to a variable output pump for use primarily as a fuel supply pump for a diesel internal combustion engine and being of the general kind comprising a reciprocable pumping element arranged to move under the influence of a cam surface of a cam element in timed relationship with the associated engine to deliver fuel to a delivery port.

BACKGROUND OF THE INVENTION

In order to meet emission regulations, it is desirable to be able to vary the pumping output, and in particular the pumping rate, for a particular speed of rotation of the distributor member, in order to optimise the fuel injection rate over as much as possible of the engine speed and load range.

U.S. Pat. No. 2,561,519 describes a variable output pump which comprises a rotatable member having a plurality of bores extending parallel to the axis of the member, a pair of plungers being reciprocable within each bore. A compression spring is provided between the plungers in each bore to bias the plungers away from one another. The pump further comprises a pair of cam rings, one plunger of each pair being reciprocable under the influence of a fixed one of the cam rings, the other plunger of each pair being reciprocable under the influence of the other, moveable cam ring. Each of the cam rings includes a plurality of cam lobes, the plungers being pushed inwardly by the lobes to expel fluid from the bores.

It will be understood that by adjusting the position of one of the cam rings, the output of the pump can be adjusted.

SUMMARY OF THE INVENTION

An object of the invention is to provide an improved variable output pump of relatively simple construction and operation, which is adjustable, while operating, in order to vary the pump output.

According to the present invention there is provided a variable output pump comprising a pumping element reciprocable within a bore, the pumping element being reciprocable under the influence of the effective cam surface of a variable cam arrangement, and characterized in that the cam arrangement includes a plurality of cam surfaces, the cam arrangement being variable to adjust the shape of the effective cam surface to vary the delivery rate of the pump.

The variable cam arrangement conveniently comprises a plurality of relatively moveable cam surfaces, relative movement of the cam surfaces adjusting the shape of the effective cam surface.

Typically, relative movement of the cam surfaces is effected in dependence upon a control pressure which is conveniently derived from the pump inlet pressure and actuates a piston device for effecting the selective relative movement of the cam surfaces.

BRIEF DESCRIPTION OF THE DRAWINGS

Alternatively, the cam arrangement may comprise a plurality of relatively fixed cam surfaces, respective cam followers being arranged to engage the cam surfaces, the cam followers being relatively moveable in order to adjust the shape of the effective cam surface.

The invention will further be described, by way of example, with reference to the accompanying drawings, in which.

DETAILED DESCRIPTION OF THE PREFERRED EMBODIMENTS

Figure 1:
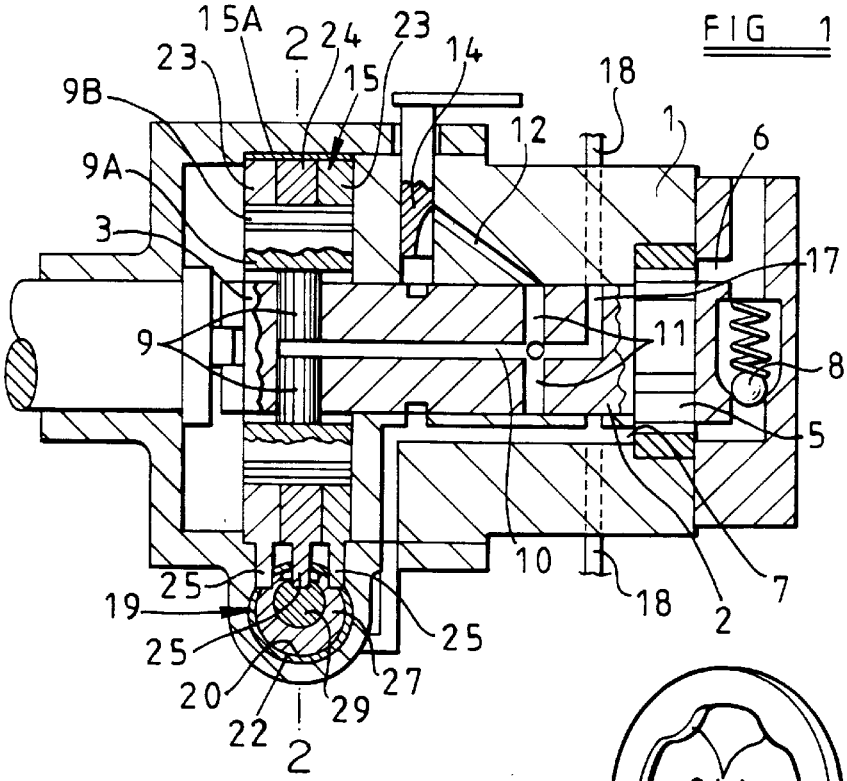
FIG. 1 is a cross sectional view of one form of distributor pump assembly of the invention.

Referring to FIG. 1, the illustrated example of a distributor pump assembly comprises a body 1 in which is mounted a rotary cylindrical distributor member 2 having at one end a head 3 with a diametrically extending bore within which are slidably mounted respective reciprocable pumping elements in the form of plungers 9. The radially outer ends of the plungers 9 engage shoes 9A which carry respective rollers 9B of which the axes are disposed parallel to the axis of rotation of the distributor member 2. The pumping plungers 9 are surrounded by a cam ring assembly 15 which engages a bearing element 15A lining the internal wall of the housing. The plungers are arranged to be moved inwardly as the distributor member is rotated by the action of a plurality of cam lobes projecting inwardly of the internal peripheral surfaces of three cam rings 23, 24 which constitute the cam ring assembly. The distributor member has a longitudinal bore 10 which communicates with a radially outwardly extending delivery passage 17 arranged to register in turn, as the distributor member rotates, with a plurality of outlet ports 18 which, in use, are connected respectively to injection nozzles mounted on the associated engine.

Figure 5:
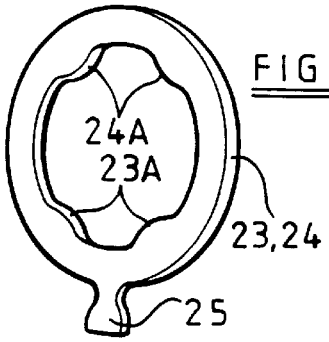
FIG. 5 is an isometric view of one form of cam ring.

The cam ring assembly 15 comprises first and third identical cam rings 23 between which the second cam ring 24 is sandwiched, each cam ring being provided with four equi-angularly spaced cam lobes, as can be seen more clearly from the single ring illustrated in FIG. 5. The leading flanks of the lobes 24A provided on the second cam ring 24 are shaped so as to produce a different e.g. lower pumping rate than the cam lobes 23A provided on the first and third cam rings 23, although it would be possible to use a reverse arrangement of the cams. Each of the cam rings 23, 24 is provided with an integral peg 25 arranged, in relation to the cam lobes, so that when the pegs 25 align with one another, the leading flanks of the lobes 23A provided on the first and third cam rings 23 are engaged by the rollers 9B of the plungers 9, the leading flanks of the lobes 24A provided on the second ring 24 being, for this condition of the ring assembly, out of contact with the rollers. As can be seen in FIG. 1, rollers 9B are of sufficient width to extend across all three cam rings, so that the cam lobes are capable of influencing movement of the plungers 9, depending upon the relative rotary positions of the rings, as will be described hereinafter.

The longitudinal bore 10 also communicates with a plurality of equi-angularly disposed radially extending inlet passages 11 which register in turn, as the distributor member rotates, with an inlet port 12 formed in the body 1. The communication between one of the inlet passages 11 and the inlet port 12 occurs during the time when the plungers 9 are permitted to move outwardly by the cam lobes and the communication of the delivery passage 17 with one of the outlet ports 18 occurs prior to inward movement of the plungers by the action of the cam lobes.

At the opposite end of the distributor member to the bore which accommodates the plungers, is mounted the rotor of a vane type feed pump 5 having an inlet 6 and an outlet 7 in the body 1. The inlet 6 is connected, in use, to a source of liquid fuel and the inlet and outlet are interconnected by way of a valve 8 which controls the output pressure of the feed pump 5 in such a manner that it varies in accordance with the speed at which the apparatus is driven. Since the distributor member 2 is driven by the engine, the output pressure of the feed pump 5 is also dependent upon the speed of the engine and the outlet 7 of the feed pump 5 is in communication with the aforesaid inlet port 12 by way of an adjustable throttle valve 14 whereby the quantity of fuel which flows through the inlet port 12 whilst the plungers 9 are capable of moving outwardly can be varied. The throttle valve consists of an angularly adjustable cylindrical member, the setting of which is controlled by a speed responsive governor (not shown).

Figure 2:
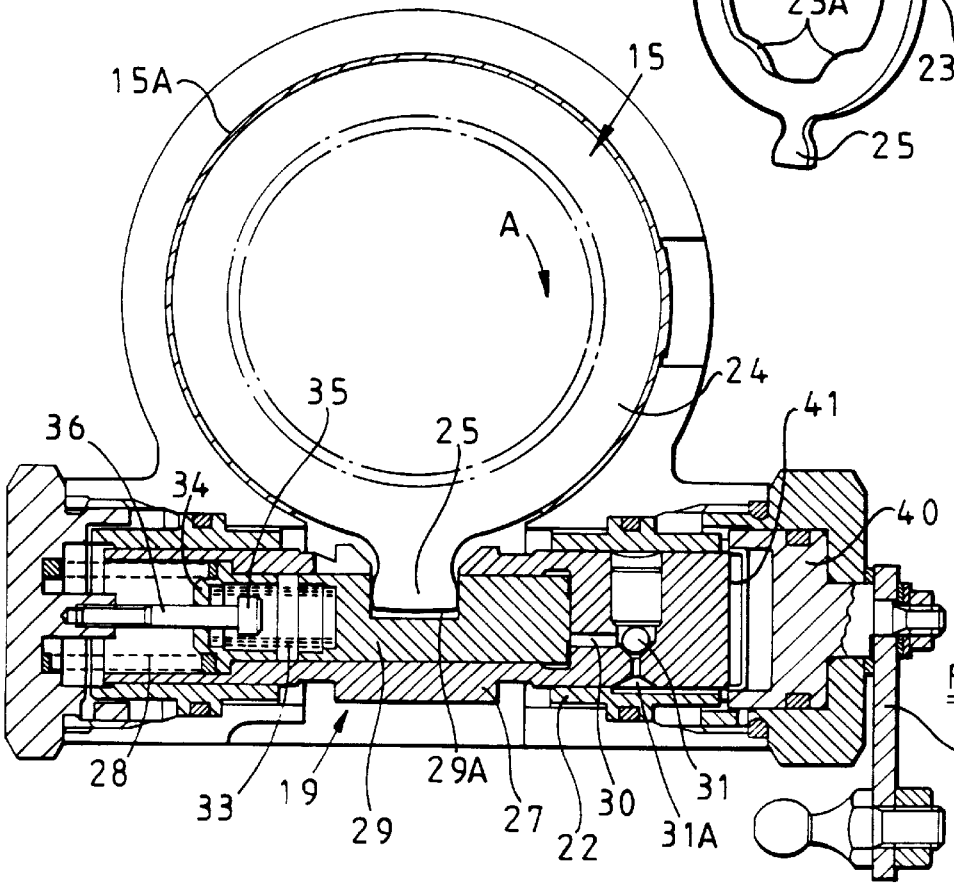
FIG. 2 is a cross sectional view along the line 2—2 of FIG. 1 omitting certain parts thereof.
Figure 4:
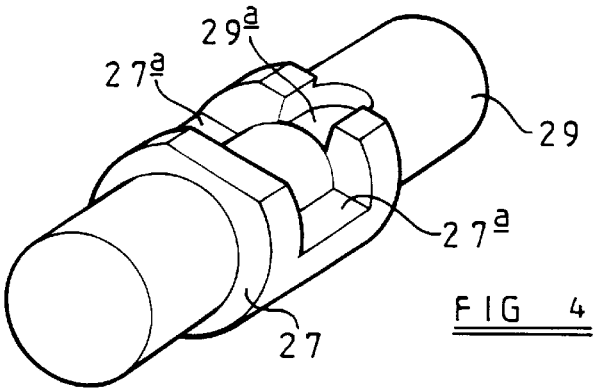
FIG. 4 is an enlarged diagrammatic perspective view of first and second pistons of the assembly of FIGS. 1 and 2.

The entire cam ring assembly 15 is angularly adjustable as a unit within the body 1 for the purpose of varying the timing of delivery of fuel to the engine, and the relative angular position of the second cam ring 24 with respect to the first and third cam rings 23 is also adjustable by means of a fluid pressure operable piston unit 19 illustrated in detail in FIGS. 2 and 4. The piston unit is mounted within a two piece sleeve 22 located within the body 1 in a cylindrical bore 20 which is tangentially disposed relative to the cam ring assembly 15. The piston unit 19 comprises a first piston 27 urged to the right, as seen in the drawing by means of a helical spring 28, acting between one internal end of the piston unit and a flange formed on a cup 34 engaged within the piston 27. A second piston 29 is slidable in a cylinder formed in the piston 27 and a second spring 33 acts between the cup and the piston 29 to bias the latter against a stop surface formed by the end of the cylinder. A headed screw 35 projecting axially within the piston 27 cooperates with the cup to limit rightwards movement of the cup during movement of the piston 27 in the same direction.

As seen more clearly from FIGS. 2 and 4, the upper surface of the first piston 27 is provided with a pair of recesses 27*a* within which engage the pegs 25 provided on the first and third cam rings 23, the second piston 29 receiving a similar peg 25 of the second cam ring 24 in a single recess 29*a* thereof.

Figure 3:
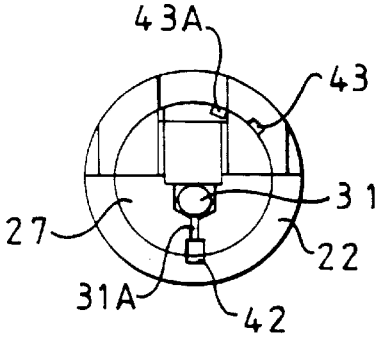
FIG. 3 is a diagrammatic sectional view of part of the mechanism of FIG. 2.

The piston 27 contains a ball lock off valve assembly, of which a ball valve element 31 controls fluid flow from a radial inlet passage 31A and an axial passage 30 of the piston 27 to the front face of the piston 29. A rotary force input sleeve 40 is keyed to the sleeve 22 by a dog arrangement, part of which can be seen at 41. Alternatively, the sleeves 40 and 22 could be made in one piece. As can be seen more clearly from FIG. 3 the sleeve 22 contains angularly spaced axial fluid grooves 42, 43 arranged to cooperate by rotation of the sleeve 40 with the passage 31A of the piston 27 and with a drain groove 43A, in the manner to be described hereinafter. Rotation of the sleeve is effected, in this embodiment, from the demand throttle lever or other, possibly automatic, means.

In use, the distributor member 2 rotates in timed relation with an associated engine. Starting from the position illustrated in FIGS. 1 and 2, fuel from the feed pump 5 enters the distributor member through the inlet port 12 and one of the inlet passages 11, the fuel being carried to the plunger bores through the longitudinal bore 10. As the rollers are not in contact with the cam rings 23, 24, the fuel entering the bores pushes the plungers 9 outwards.

As the distributor member 2 rotates, communication between the inlet passage 11 and the inlet port 12 is broken, further rotation resulting in the delivery passage 17 communicating with one of the delivery ports 18. After the delivery passage 17 and delivery port 18 come into communication with one another, the rollers move into engagement with the leading flanks of the cam lobes provided on the first and third cam rings 23, and the plungers 9 are pushed inwards due to the action of the cam lobes. The inward movement of the plungers 9 pumps fuel from the bores through the longitudinal bore 10, delivering fuel through the delivery passage 17 and delivery port 18 to a cylinder of an associated engine. This process continues until the rollers ride over the crests of the cam lobes. Further rotation breaks the communication of the delivery passage 17 with the delivery port 18, continued rotation resulting in the next inlet passage 11 registering with the inlet port 12, the cycle then repeating.

Fuel from the outlet of the feed pump 5 is applied to the right hand end of the piston 27 of the unit 19 through a passage (not shown). Since the feed pump 5 operates at the speed of the distributor member 2, the pressure of the fuel at the outlet of the feed pump 5, and hence the pressure of fuel applied to the first piston 27, is related to engine speed. It will therefore be understood that the position of the first piston 27, and hence the angular position of the first and third cam rings 23 is dependent upon engine speed, an increase in engine speed resulting in angular movement of the first and third cam rings 23 in the direction of the arrow A and contrary to the rotation of the distributor member, to advance the timing of the delivery of fuel to the cylinders of the engine. When engine speed is reduced, the pressure applied to the first piston 27 is reduced, the spring 28 moving the piston 27 to retard the timing of delivery of fuel to the engine. Because the second piston 29 is urged against the first piston by the spring 33, both of the pistons 27 and 29 are moved simultaneously by the pressure applied to the first piston. The second cam ring 24 engaged with the piston 29 is therefore also moved in response to changes in engine speed, and the relative positions of the first, second and third cam rings 23, 24 remain unchanged. During this time, the angular position of the sleeve 22 is such that there is no communication between the passages 42 and 31A so that the pressure applied to the piston 29 is the drain or housing pressure.

When it is desired to change the pumping rate of the engine, the sleeve 22 is rotated by action on the lever 44, in order to bring the passage 42 into register with passage 31A thereby to permit pressurized fuel to be applied to the second piston 29 through these passages and the axial passage 30. This pushes the second piston 29 to the left relative to the piston 27 against the action of the spring 33, moving the second cam ring 24 to a position in which at least the initial portions of the leading flanks of the cam lobes 24A thereof are slightly ahead of the leading flanks of the cam lobes 23A of the first and third cam rings 23. In this position, rotation of the distributor member 2 results in the rollers first contacting the leading flanks of the cam lobes 24A provided on the second cam ring 24, pumping fuel under the influence of the leading flanks of those cam lobes, and then contacting parts of the lobes 23A of the first and third cam rings 23.

Figure 6A:
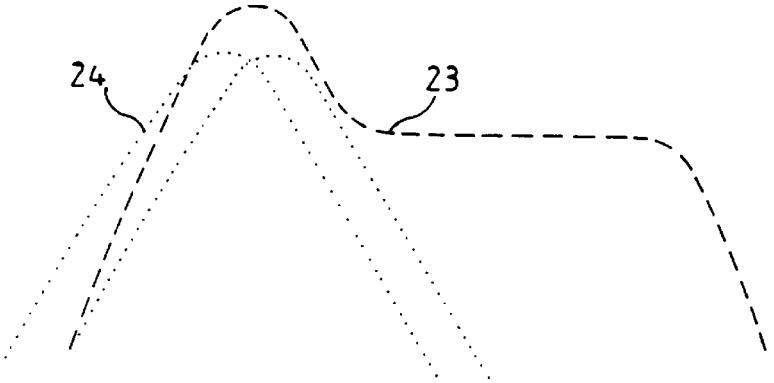
FIGS. 6*a*, 6*b* and 6*c* illustrate the effect of relative movement of cam rings in order to change pumping rate.
Figure 6B:
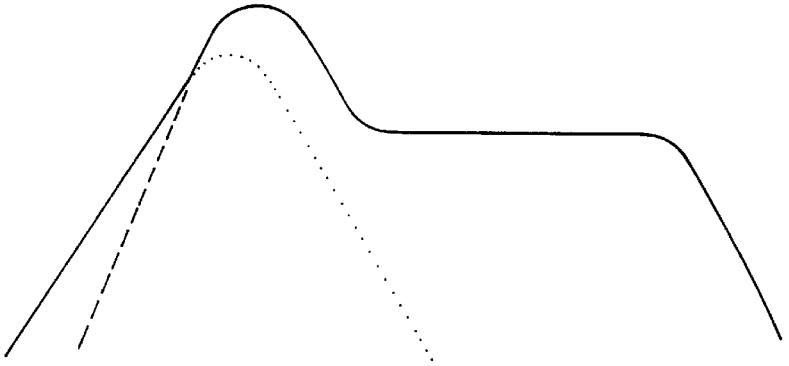
Figure 6C:
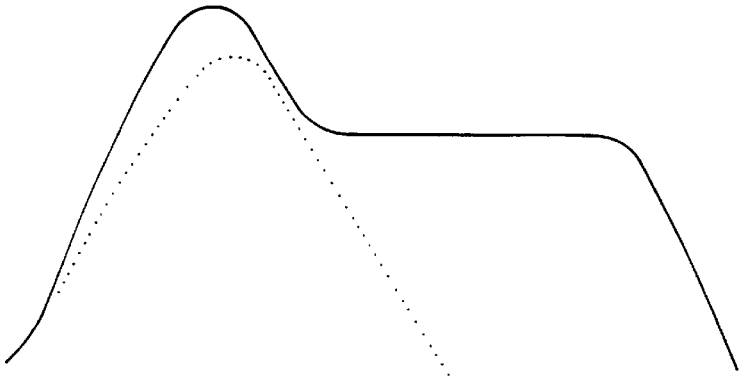

Since the rollers are of sufficient width to be influenced by the lobes of all of the cam rings, the rollers, and hence the plungers 9 are influenced by the effective cam profile at a given time. FIGS. 6*a*, 6*b* and 6*c* illustrate the effect of the change in the relative positions of the cam rings 23, 24. In FIG. 6*a*, the cam lobe profiles of the lobes of the first and third cam rings 23 are indicated by a dashed line, the two extreme relative positions of the cam lobes of the second cam ring 24 being indicated by dotted lines. In FIG. 6*b*, the solid line illustrates the effective cam profile with the second cam ring 24 in its advanced position with respect to the first and third cam rings 23, the solid line in FIG. 6*c* showing the effective cam profile with the second cam ring 24 in a relatively retarded position.

In order to return to the original pumping rate, the sleeve 22 is moved angularly in the reverse direction to bring the groove 43 into register with the drain groove 43A enabling the fuel under pressure to drain from the cylinder containing the second piston 29 thereby allowing the second piston 29 to return to its original position with respect to the first piston 27, under the action of the spring 33.

Using the piston arrangement described above facilitates the establishment of "start retard" and "running retard" conditions necessary for operating an associated diesel engine. When the engine is inoperative, the piston unit 19 assumes a condition in which the spring 28 urges the piston assembly to the right to an extent governed by abutment of the cup 34 against the head 35 of the fixed axially extending screw 36. The smaller spring 33 then urges the piston assembly further to the right, until the piston 27 abuts the inner end of the rotary sleeve 40. As the engine is cranked for starting, the small pressure generated is insufficient to overcome the force of the small spring and the piston assembly remains in the extreme right hand position to establish the start retard condition. Once the engine has started and reached idling speed, the pressure is then sufficient to move the piston assembly to the left by a small amount to establish a running retard condition. Further increase in engine speed will move the piston assembly further to produce a corresponding decrease in the retard.

In a modification of the above described embodiment, the cup 34 and the spring used to bias the first piston 27 is omitted and instead a single spring is used to bias the piston, the spring being arranged between the second piston 29 and one end of the piston unit. When pressurized fuel is not applied to the second piston, the end of the second piston engages the first piston, the spring acting to push both pistons to positions in which the timing of fuel delivery is retarded. If fuel under pressure is applied to the second piston 29, the first piston will move with respect to the second piston resulting in the first and third cam rings moving to a position in which the cam lobes of the second cam ring are advanced with respect to those of the first and third cam rings. In a variation of this embodiment, rather than applying fuel to the second piston in order to produce a change in the relative positions of the cam rings, a mechanical wedge may be used to separate the first and second pistons, for example in the form of a screw threaded member or a cam. Such an arrangement is illustrated in FIG. 13.

Figure 13:
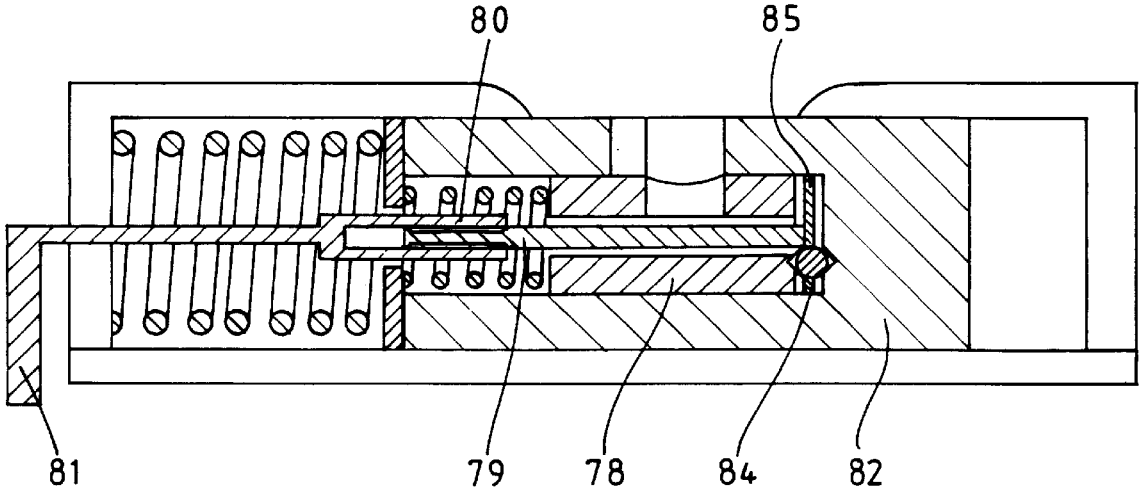
FIG. 13 is a section through an alternative form of cam ring operating mechanism.

As shown in FIG. 13 the first piston 78 is provided with a central drilling through which extends an angularly adjustable rod 79 and which is coupled by means of a spline connection 80 to an external angularly movable lever 81. The end face of the piston 78 and the base wall of the cylinder in the second piston 82 in which the piston is mounted are each provided with a series of angularly spaced detents. Mounted in each pair of opposed detents is a ball 84 which extends through a respective aperture formed in a disc 85 mounted on the adjacent end of the rod 79. When the lever 81 is moved angularly the balls are forced out of the detents and cause relative movement of the two pistons. The rod can extend through a drilling formed in the second piston 82 but in this case seals will be required to prevent escape of fuel under pressure.

Figure 8A:
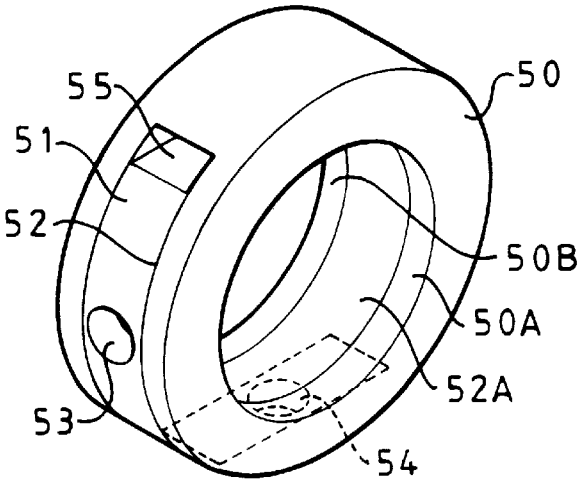
FIGS. 8*a*, 8*b* and 8*c* are isometric views of part of a cam ring arrangement of an alternative distributor pump assembly.
Figure 8B:
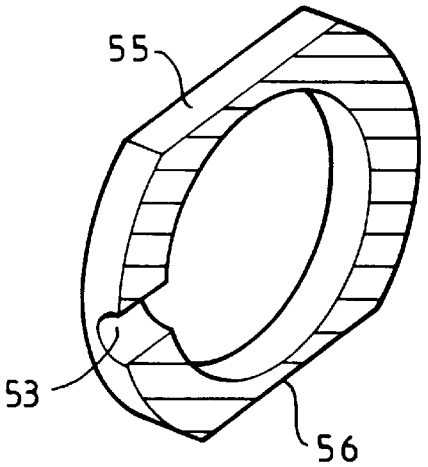
Figure 8C:
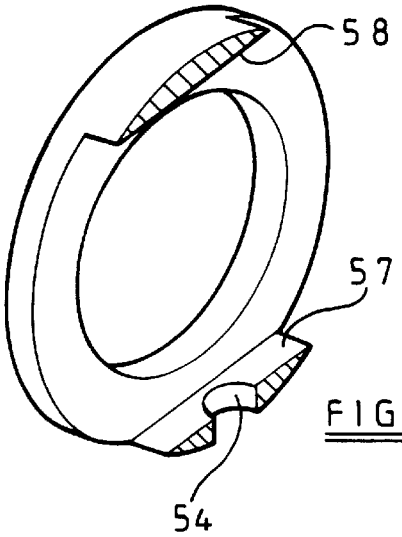

In a modification to the above described embodiment, the three cam rings are replaced by a composite cam ring as shown in FIGS. 8*a*, 8*b* and 8*c*, FIG. 8*a* showing the complete assembly and FIGS. 8*b* and 8*c* respectively the two component parts of the assembly, each split along the shaded areas.

An outer composite cam ring 50 is divided to provide a slot 52 receiving a second cam ring 51. The ring 50 provides a pair of cam surfaces 50A, 50B which would be profiled as required. The ring 52 provides a single cam surface 52A between the surfaces 50A and 50B and is similarly profiled. The composite and single rings are provided respectively with respective openings 53, 54 extending generally at right angles to each other and adapted to receive actuating pegs 159, 164 enabling them to be connected to respective advance boxes which would conveniently be arranged at right angles to each other. The ring 51 has diametrically opposed flats 55, 56 lying generally parallel with the opening 53 and the ring 50 has corresponding adjacent internal flats 57, 58, the distance between the flats 55, 56 being significantly less than that between the internal flats 57, 58, to permit limited relative angular movement between the rings.

Figure 11:
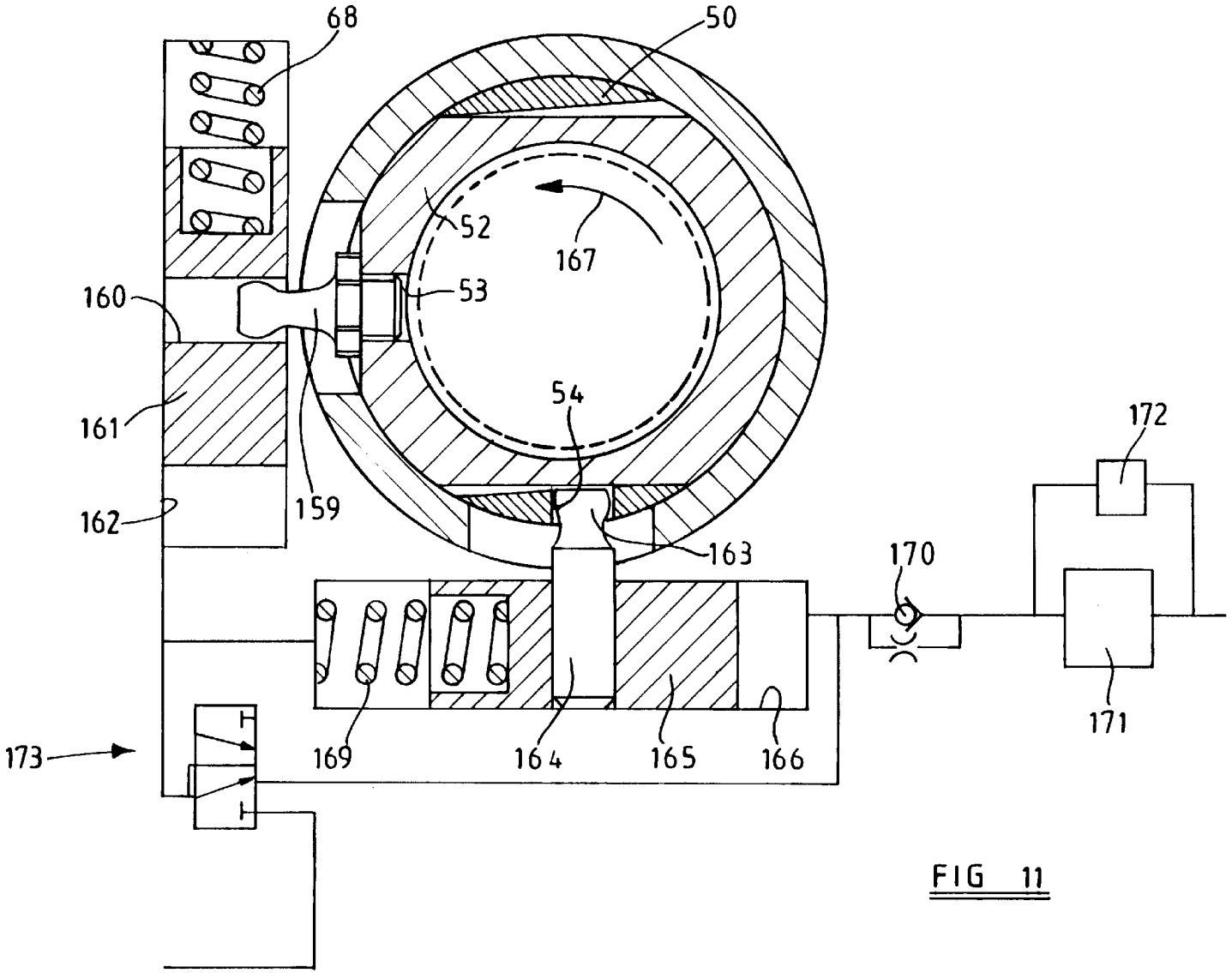
FIG. 11 is a sectional view of the cam ring assembly of FIG. 8*a* also showing the cam ring operating mechanism in one setting.
Figure 12:
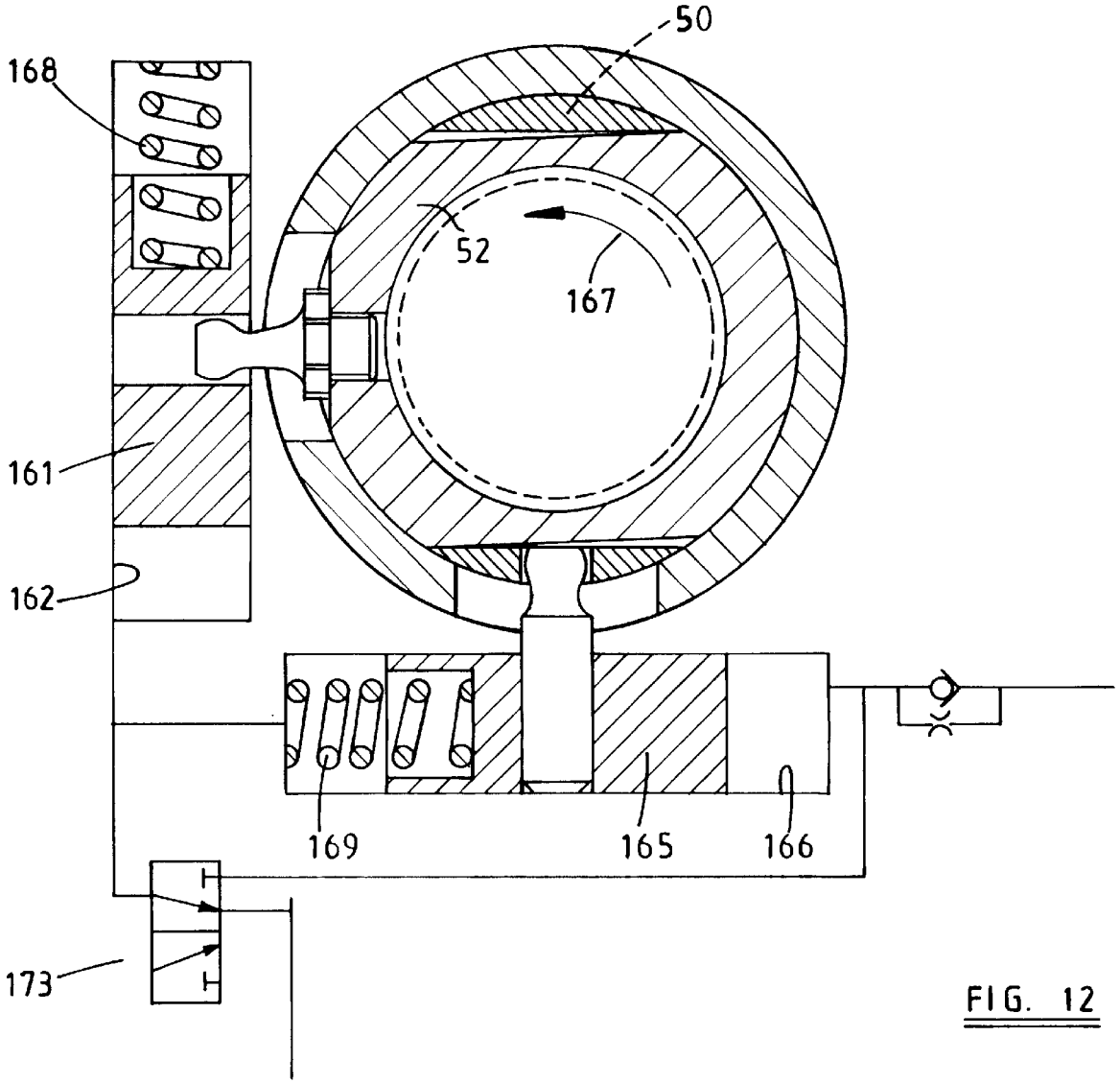
FIG. 12 is a view similar to FIG. 11 showing an alternative setting.

One arrangement for the advance boxes is illustrated in FIGS. 11 and 12 in which the opening 53 is screw threaded and a peg 159 is located therein the peg having a rounded end which locates within a transverse bore 160 formed in a piston 161 slidable within a cylinder 162. The opening 54 accommodates the spherical end 163 of a pin 164 which is located in a piston 165 slidable within a cylinder 166.

The direction of rotation of the distributor member within the cam ring assembly is illustrated by the arrow 167 and the pistons 161 and 165 are biased by coiled compression springs 168 and 169 respectively in a direction to urge the cam rings in the direction of rotation of the distributor member. In the case of the cylinder 166 the opposite end of the cylinder to that which contains the spring, is connected by way of an anti-shock valve 170 to the outlet of the low pressure pump 171. The outlet pressure of the low pressure pump is controlled by a relief valve 172 so that the pressure at its outlet varies in accordance with the speed at which the injection pump is driven.

There is also provided a two position changeover valve 173 and in one setting as shown in FIG. 11, this connects the end of the cylinder 162 remote from the spring 168, with the outlet of the pump 171 by way of the anti-shock valve. In addition, the end of the cylinder 166 which contains the spring 169 is permanently connected to the end of the cylinder 162 remote from the spring 168. In this setting of the valve 173, the ends of the cylinder 166 are at the same pressure and therefore only the force exerted by the spring 169 is effective upon the piston. The piston therefore moves the cam ring 50 in the anti-clockwise direction relative to the cam ring 52 such movement being allowed by the spacing between the respective flats. The piston 161 is however subject to the outlet pressure of the low pressure pump and its axial position therefore varies with variation in the fuel pressure. With an increase in the fuel pressure as occurs when the speed of the associated engine increases, the piston 161 will move against the action of the spring 68 and also the spring 169, to advance the timing of delivery of fuel by the associated engine. It will be appreciated that the leading flanks of the cam lobes on the cam ring 52 will be effective to determine the rate at which the pumping plungers are moved inwardly since these cam lobes will lie in advance of the cam lobes on the cam ring 50.

In the alternative position of the changeover valve as shown in FIG. 12, the end of the cylinder 166 containing the spring 169 and also the end of the cylinder 162 remote from the spring 168 are connected to a drain and therefore there is no fluid pressure acting on the piston 161 so that the spring 68 moves the cam ring 52 relative to the cam ring 50 so that the cam rings assume their opposite alternative position to that shown in FIG. 11. The fuel under pressure from the low pressure pump acts on the piston 165 to generate a force which is opposed by both springs 168 and 169 so that the setting of the cam rings once again depends upon the output pressure of the pump and with increasing pressure the cam rings move in the direction to advance the timing of fuel delivery. With the relative position of the cam rings as shown in FIG. 12, it is the leading flanks of the cam lobes on the cam ring 50 which effect the inward movement of the pumping plungers.

It will be understood that the cam rings 50, 52 could be coupled to the other piston respectively and that providing the dimensions of the cams are suitable either form of connection to the associated pistons can be used.

In the arrangement illustrated in FIGS. 11 and 12, the spring 169 need not be provided but in this case it is desirable to provide for fluid pressure biasing of the piston 165 towards the right hand end of the cylinder. This can be achieved by ensuring that the pressure applied to the left hand end of the piston 165 in the setting of the valve 173 as shown in FIG. 11 is higher than that applied to the right hand end or by arranging that the left hand end of the piston 165 has a slightly larger diameter.

In the above described embodiment, the rollers extend across all of the cam surfaces and are hence influenced selectively by different combinations of cam profiles in order to switch pumping rates as a result of actuating the advance boxes. When the flats of the inner and outer rings engage, the assembly becomes solid and can be rotated in one direction or the other to effect a desired advance or retard, one or both boxes operating as required. When a switch of pumping rates is required, one or both boxes may operate in a mode such as to produce relative rotation between the rings, with the effect described for the previous embodiment. After full relative movement of the rings has taken place they once again become solid and can operate again as one under the joint actions of the two advance boxes.

Figure 7A:
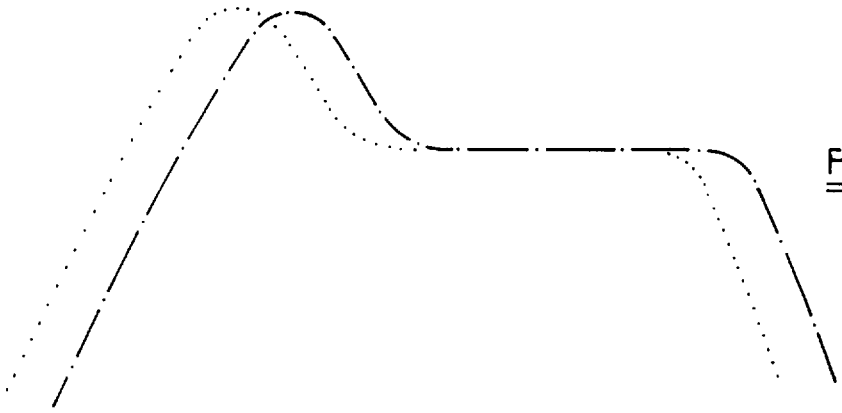
FIGS. 7*a*, 7*b* and 7*c* are similar to FIGS. 6*a*, 6*b* and 6*c* where the movement results in a change in the pumping duration.
Figure 7B:
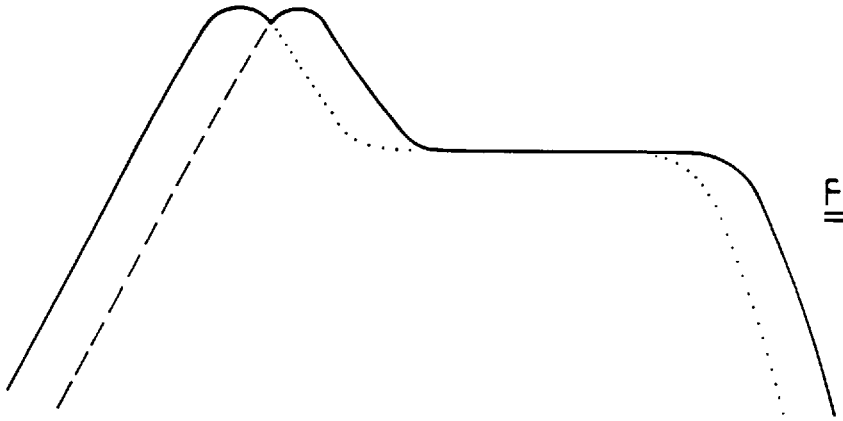
Figure 7C:
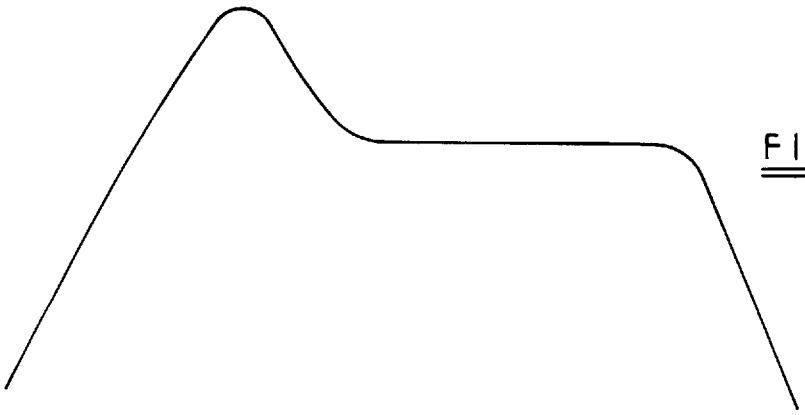

Either of the above described embodiments may be modified by replacing the cam lobes having different pumping rate leading flanks with cam lobes of the same or similar profile, the movement of the second cam ring with respect to the other cam ring resulting in the duration of pumping extending from a first duration when the cam lobes are aligned with one another, to an extended duration when the cam lobes of the second cam ring are advanced with respect to the cam lobes of the other ring, the rollers and plungers being influenced by the leading flanks of the cam lobes of the second cam ring, and by the trailing flanks of the cam lobes of the other cam ring. The effect of using such cam lobes is illustrated in FIGS. 7*a*, 7*b* and 7*c* which are similar to FIGS. 6*a*, 6*b* and 6*c* described hereinbefore, FIGS. 7*b* and 7*c* showing that the pumping duration and hence the mean pumping rate over the delivery period can be altered by adjusting the relative angular positions of the first, second and third cam lobes.

Figure 9:
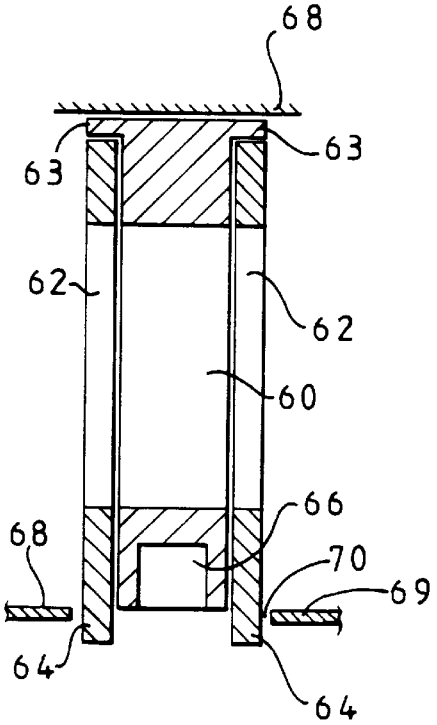
FIGS. 9 and 10 are respectively cross-sectional and end views of an alternative cam ring assembly.
Figure 10:
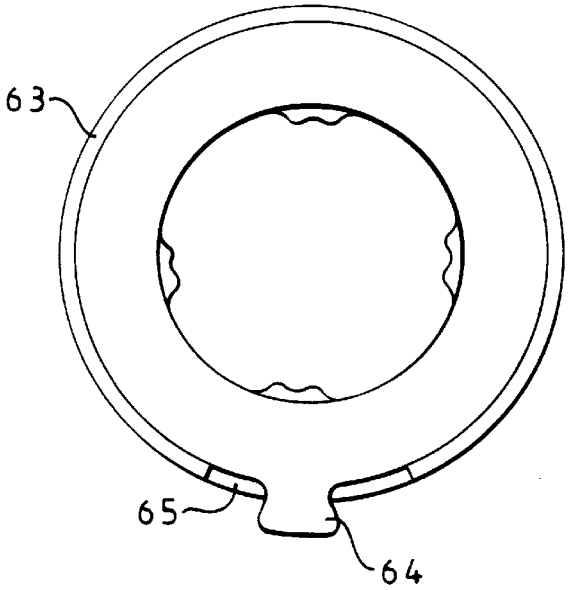

An alternative form of three cam assembly is illustrated in FIGS. 9 and 10. It will be seen that the middle cam 60 of the assembly is of very much greater width than the two identical outer cams 62 and is provided with opposed projecting peripheral flanges 63 around a major part of its circumference forming oppositely facing recesses within which the cams 62 are received. The outer cams 62 are provided with pegs 64 for engagement in the outer piston 27 of the piston unit 19 (FIGS. 2 and 4) and the flanges 63 are interrupted at appropriate locations to form gaps 65 to permit the pegs to be extended outwardly for engagement with the piston 27 as aforesaid. The middle cam has a radial hole 66 into which a suitable peg (not shown) may be screwed, or otherwise secured, enabling the middle cam to be engaged with the piston 29. It will be noted that the two outer cams are located and rotate within the recesses of the middle cam.

The generally cylindrical pump housing, of which portions can be seen at 68, forms a cylindrical bore 69 having a diameter smaller than that of the cam assembly, including the pegs 64. In order to assemble the cams into the housing, one procedure is to take one of the outer rings and place it in the bore 69 at an angle with its peg 64 inserted through an opening 70 in the housing wall and then tilt the cam into the upright position shown. The inner cam (without peg) may then be slid axially down the housing bore into engagement with installed outer cam, following which the other outer cam may be placed in position by repeating the insertion/tilting procedure described above. The piston unit 19 or advance box may then be offered to the pump housing to engage the tongues with the pistons, following which the unit is clamped in position for use.

It will be understood that the above-described principle may be applied to the cam ring assembly of FIGS. 1 and 2, it being envisaged that the bearing element 15A could be inserted after assembling the cam rings.

The invention is also applicable to the form of pump in which the distributor member besides rotating to provide the distribution action is also axially movable and forms the pumping element. In this case the distributor member is secured to a face cam having cam lobes which cooperate with rollers which are axially fixed within the pump housing. The rollers are mounted in a cage which is angularly adjustable about the axis of rotation of the distributor member to enable the timing of fuel delivery to be varied. In applying the invention to such a pump the face cam is provided with two series of cam lobes having different profiles and two series of rollers are provided. Conveniently the one series of cam lobes is located outwardly of the other series and the two series of rollers are positioned in like manner. In this case the two series of rollers are angularly adjustable relative to each other so that the axial movement of the distributor member to achieve fuel delivery can be effected by one or the other series of cam lobes.

We claim:

1. A variable output high pressure fuel pump comprising a pumping element reciprocable within a bore, the bore communicating with an inlet whereby fluid is supplied to the bore, and with an outlet, the pumping element being reciprocable under the influence of a variable cam arrangement to supply fluid from the bore to the outlet under pressure, the cam arrangement including distinct first and second cam rings, and cam follower means for engaging the first and second cam rings and being associated with each of the first and second cam rings, the cam follower means being engageable with the first and second cam rings, one of (a) relative positions of the cam rings and (b) relative positions of the cam follower means being adjustable to determine which one of the first and second cam rings is used to drive the pumping element, thereby controlling a shape of an effective cam profile of the variable cam arrangement to adjust the rate of movement of the pumping element within the bore and hence adjust the instantaneous delivery rate of the pump.

2. A pump as claimed in claim 1, wherein the cam arrangement includes a plurality of cam surfaces.

3. A pump as claimed in claim 2, wherein the cam surfaces are provided on said cam rings, the cam surfaces being moveable by moving the cam rings with respect to one another.

4. A pump as claimed in claim 3, wherein the cam arrangement comprises three cam rings, first and third ones of the rings having identical cam surfaces, the second ring being provided between the first and third rings.

5. A pump as claimed in claim 4, wherein the first and third rings are integral with one another, the second ring being received within a slot provided in a body defining the first and third rings.

6. A pump as claimed in claim 4, wherein the cam surface of the second cam ring is shaped differently to those of the first and third rings.

7. A pump as claimed in claim 4, wherein the cam surface of the second cam ring is of substantially the same profile as those of the first and third rings.

8. A pump as claimed in claim 1, wherein the cam arrangement includes a plurality of cam surfaces, respective cam followers being arranged to engage the cam surfaces, the cam followers being relatively moveable in order to adjust the delivery rate of the pump.

9. A pump as claimed in claim 1, wherein said cam follower means includes piston means for operating the cam rings for adjusting the delivery rate of the pump.

10. A pump as claimed in claim 9, wherein the piston means comprises at least two pistons.

11. A pump as claimed in claim 9, wherein the piston means comprises a first piston moveable within a cylinder, and a second piston moveable within a cylinder.

12. A pump as claimed in claim 11, wherein relative positions of cam surfaces of the cam arrangement are adjustable, and relative movement of the first and second pistons adjusting the relative positions of the cam surfaces of the cam arrangement.

13. A pump as claimed in claim 11, further comprises valve means for selectively apply substantially the same fluid pressure to both sides of one of the pistons.

14. A pump as claimed in claim 13, wherein the valve means is further arranged to selectively connect a side of at least one of the pistons to drain.

15. A pump as claimed in claim 11, wherein the second piston is moveable within a cylinder provided in the first piston.

16. A pump as claimed in claim 12, including mechanical means operable to effect relative movement of the pistons.

17. A variable output pump comprising a pumping element reciprocable within a bore, the bore communicating with an inlet whereby fluid is supplied to the bore, and with an outlet, the pumping element being reciprocable under the influence of a variable cam arrangement to supply fluid from the bore to the outlet under pressure, the cam arrangement including a plurality of cam surfaces, the cam arrangement being variable to adjust the delivery rate of the pump, piston means for operating the cam arrangement for adjusting the delivery rate of the pump, the piston means including a first piston moveable within a cylinder, and a second piston moveable within a cylinder, and relative positions of the cam surfaces being adjustable with relative movement of the first and second pistons adjusting the relative positions of the cam surfaces of the variable cam arrangement.

* * * * *